US007051381B2

(12) United States Patent
Furukawa et al.

(10) Patent No.: US 7,051,381 B2
(45) Date of Patent: May 30, 2006

(54) SANITARY CLEANSING DEVICE

(75) Inventors: Hideki Furukawa, Anjo (JP); Toshiyuki Torii, Hekinan (JP); Yoshifumi Makino, Ichinomiya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 113 days.

(21) Appl. No.: 10/201,019

(22) Filed: Jul. 24, 2002

(65) Prior Publication Data

US 2003/0019023 A1 Jan. 30, 2003

(30) Foreign Application Priority Data

Jul. 30, 2001 (JP) ..... 2001-230560

(51) Int. Cl.
*A47K 13/10* (2006.01)

(52) U.S. Cl. ..... 4/246.1
(58) Field of Classification Search ..... 4/246.1, 4/420.4
See application file for complete search history.

(56) References Cited

U.S. PATENT DOCUMENTS 5,878,444 A * 3/1999 Convoy ..... 4/246.1
6,321,393 B1 * 11/2001 Jones ..... 4/246.1

FOREIGN PATENT DOCUMENTS

JP 2001-95722 4/2001

* cited by examiner

*Primary Examiner*—Charles E. Phillips
(74) *Attorney, Agent, or Firm*—Oblon, Spivak, McClelland, Maier & Neustadt, P.C.

(57) ABSTRACT

The present invention provides a sanitary cleansing device includes a casing to be attached onto a rear portion of a toilet bowl, a toilet seat rotatably connected to the casing, a toilet lid rotatably connected to the casing for selectively covering the toilet seat, a first human detection sensor placed at a position in the casing such that the first human detection is made free from recognizing the toilet lid which is in its closed state, a second human detection sensor placed at a position in the casing such that the second human detection is made free from recognizing the toilet seat when the toilet seat is in its opened state and the toilet lid is in its opened state, and an automatic open/close mechanism opening/closing at least one of the toilet lid and the toilet seat upon receipt of a signal from either of the first human detection sensor and the second human detection sensor.

18 Claims, 6 Drawing Sheets

SANITARY CLEANSING DEVICE

The present application is based on and claims priority under 35 U.S.C § 119 with respect to Japanese Patent Application No. 2001-230560 on Jul. 30, 2001 (13th Year of Heisei), the entire content of which is incorporated herein by reference.

BACKGROUND OF THE INVENTION

1. Field of the Invention

The present invention is generally directed to a sanitary cleansing device in which based on a signal issued from a human detection sensor a toilet seat, a toilet lid for selectively covering the toilet seat, or the toilet seat and the toilet lid as a unit is pivoted or rotated relative to a toilet bowl between a vertical-upright position (i.e. fully raised position) and a horizontal-down position (i.e. fully lowered position).

2. Prior Art

One of conventional sanitary cleansing devices of the type is disclosed in Japanese Patent Laid-open Print No. 2001-95722. This sanitary cleansing device, as shown in FIG. 10, includes a casing 24 to which are rotatably connected a toilet seat 21 and a toilet lid 25. At a front inside portion of the casing 24, there is installed a first human detection sensor 22 and a second human detection sensor 23. The toilet seat 21 is made rotatable between its fully raised position (i.e. opened state) depicted in solid line and fully lowered position (i.e. closed state) depicted in phantom line. Each of the first human detection sensor 22 and the second detection sensor 23 emits or illuminates a light beam to an angular range space between the fully raised and lowered positions of the toilet seat 21. Thus, the light beam illuminations of each of the first human detection sensor 22 and the second detection sensor 23 are positioned below the toilet seat 21, while the light beam illuminations of each of the first human detection sensor 22 and the second detection sensor 23 are positioned above the toilet seat 21.

In addition, in a case where the toilet lid 25 and the toilet seat 21 are in the respective opened and closed states, when an individual (not shown) sits on the toilet seat 21, on the basis of a detection signal issued from the first human detection sensor 22, the cleansing device is made ready for operations such as human private portion washing and deodorizing. When he/she moves away from the toilet seat 21 after completion of defecation, the resulting his/her position is detected by the first human detection sensor 22, which makes it possible to close the toilet lid 25 and/or wash an inside of a toilet bowl (not shown).

Moreover, if the individual moves away from the cleansing device after urine which is performed such that while both the toilet lid 25 and the toilet seat 21 are in the respective opened states he discharges urine toward an interior of the toilet bowl, the second human detection sensor 23 detects his moving away behavior from the toilet bowl, which makes it possible to close the toilet lid 25 and/or wash an inside of a toilet bowl.

However, in the above-described or conventional sanitary cleansing device, to prevent the human detection sensor 22 from detecting the toilet lid 25 which is in its fully closed state, the human detection sensor 22 is made compulsory or forced turned-off whenever the toilet lid 25 which is brought into its fully closed state. Thus, it is impossible to open automatically the toilet lid 25 and the toilet seat 22 while the toilet lid 25 is in its fully closed state.

Thus, a need exists to provide a sanitary cleansing device which is free from the aforementioned drawbacks.

SUMMARY OF THE INVENTION

Accordingly in order to meet the above need to overcome the aforementioned drawbacks or problems, a first aspect of the present invention provides a sanitary cleansing device which comprises:

a toilet seat for permitting an individual to sit over a toilet bowl;

a toilet lid for selectively covering the toilet seat;

a first human detection sensor placed at a front portion of a casing such that the first human detection is made free from recognizing the toilet lid which is in its closed state;

a second human detection sensor placed at the front portion of the casing such that the second human detection is made free from recognizing the toilet seat when the toilet seat is in its opened state and the toilet lid is in its opened state; and an automatic open/close mechanism pivoting the toilet lid and/or the toilet seat upon receipt of a signal from either of the first human detection sensor and the second human detection sensor.

A second aspect of the present invention is to provide a sanitary cleansing device whose gist is to modify the structure of the first aspect, wherein (1) when the toilet seat and the toilet lid are in the respective closed states, only the first human detection sensor is made to detect whether or not an individual accesses to the toilet bowl, (2) when the toilet seat is in its closed state and the toilet lid is in its opened state, one of the first human detection sensor and the second human detection sensor is made to detect whether or not an individual accesses to the toilet bowl, the other is being made to detect whether or not the individual sits on the toilet seat, and (3) when the toilet seat and the toilet lid are in the respective opened states, only the second human detection sensor is made to detect whether or not an individual accesses to the toilet bowl.

A third aspect of the present invention is to provide a sanitary cleansing device whose gist is to modify the structure of the first aspect, wherein the first human detection is capable of being switched to detect whether or not an individual accesses to the toilet bowl, while the second human detection sensor is capable of being switched to detect whether or not the individual sits on the toilet seat.

A fourth aspect of the present invention is to provide a sanitary cleansing device whose gist is to add the structure of the first aspect a position detection device which is capable of detecting three conditions: (1) the toilet seat and toilet lid are in the respective closed states, (2) the toilet seat and toilet lid are in the closed and opened states, respectively, and (3) the toilet seat and toilet lid are in the respective opened states.

A fifth aspect of the present invention is to provide a sanitary cleansing device whose gist is to modify the structure of the fourth aspect, wherein the position detection device is in the form of a pair of magnet sensors which are in association with the toilet seat and the toilet lid, respectively.

A sixth aspect of the present invention is to provide a sanitary cleansing device whose gist is to modify the structure of the first aspect, wherein at least one of the first human detection sensor and the second human detection sensor is in the form of a ranging type photoelectric sensor.

A seventh aspect of the present invention is to provide a sanitary cleansing device which comprises:

a toilet seat for permitting a user to sit over a toilet bowl;

a toilet lid for selectively covering the toilet seat;

a first human detection sensor placed at a position such that the first human detection is made free from recognizing the toilet lid which is in its vertical-upright position;

a second human detection sensor placed at a position such that the second human detection is made free from recognizing the toilet seat when the toilet seat is in its vertical-upright position and the toilet lid is in its horizontal-down position; and an automatic open/close mechanism causing the toilet lid, the toilet seat, or the toilet lid and the toilet seat as a unit to rotate relative to the toilet bowl between a vertical-upright position and a horizontal-down position upon receipt of a signal from either of the first human detection sensor and the second human detection sensor.

A eighth aspect of the present invention is to provide a sanitary cleansing device whose gist is to modify the structure of the seventh aspect, wherein (1) when the toilet seat and the toilet lid are in the respective horizontal-down position, only the first human detection sensor is made to detect whether or not the user accesses to the toilet bowl, (2) when the toilet seat is in the horizontal-down position and the toilet lid is in the vertical-upright position, one of the first human detection sensor and the second human detection sensor is made to detect whether or not the user accesses to the toilet bowl, the other is being made to detect whether or not the user sits on the toilet seat, and (3) when the toilet seat and the toilet lid are in the respective vertical-upright positions, only the second human detection sensor is made to detect whether or not the user accesses to the toilet bowl.

A ninth aspect of the present invention is to provide a sanitary cleansing device whose gist is to modify the structure of the, wherein the first human detection is capable of being switched to detect whether or not the user accesses to the toilet bowl, while the second human detection sensor is capable of being switched to detect whether or not the user sits on the toilet seat.

A tenth aspect of the present invention is to provide a sanitary cleansing device whose gist is to add the structure of the seventh aspect a position detection device which is capable of detecting three conditions: (1) the toilet seat and toilet lid are in the respective horizontal-down positions, (2) the toilet seat and toilet lid are in the horizontal-down and vertical-upright positions, respectively, and (3) the toilet seat and toilet lid are in the respective vertical-upright positions.

An eleventh aspect of the present invention is to provide a sanitary cleansing device whose gist is to modify the structure of the seventh aspect, wherein the position detection device is in the form of a pair of magnet sensors which are in association with the toilet seat and the toilet lid, respectively.

A twelfth aspect of the present invention is to provide a sanitary cleansing device whose gist is to modify the structure of the seventh aspect, wherein at least one of the first human detection sensor and the second human detection sensor is in the form of a ranging type photoelectric sensor.

A thirteenth aspect of the present invention is to provide a sanitary cleansing device whose gist is to modify the structure of the seventh aspect, wherein each of the toilet seat and the toilet lid has a rotation axis at its rear end portion, the rotation axis being placed in front of each of the first human detection sensor and the second human detection sensor.

A fourteenth aspect of the present invention is to provide a sanitary cleansing device whose gist is to modify the structure of the seventh aspect, wherein the first human detection sensor and the second human detection sensor are arranged vertically.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Figure 1:
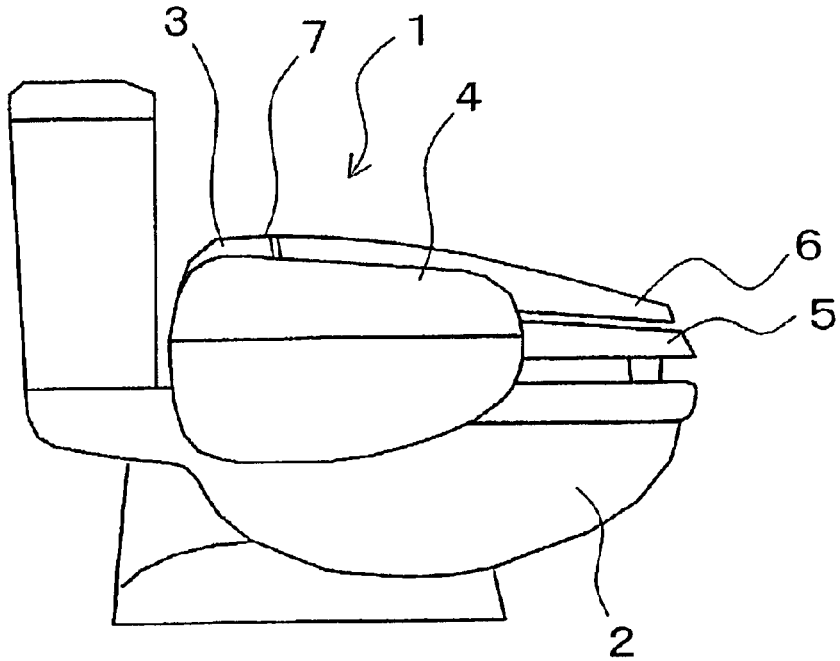
FIG. 1 shows a side view of a sanitary cleansing device in accordance with the present invention.
Figure 2:
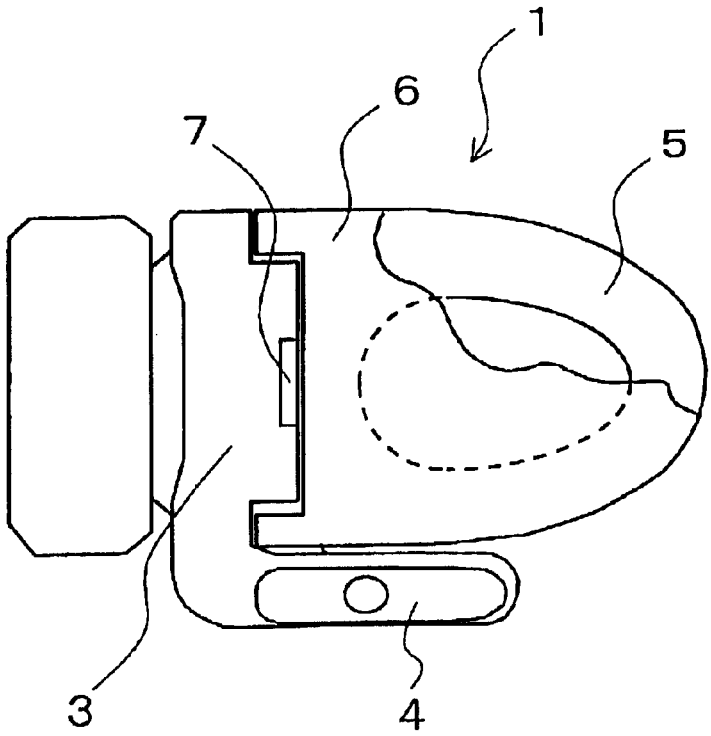
FIG. 2 shows a plane view of the sanitary cleansing device shown in FIG. 1.

Hereinafter, embodiments of the present invention will be described in great detail with reference to the attached drawings.

Referring to FIGS. 1 through 9, there is illustrated a sanitary cleansing device 1 which is detachably mounted on a rear portion of a toilet bowl 2. The sanitary cleansing device 1 includes a casing 3 which is detachably mounted on the rear portion of a toilet bowl 2. A toilet seat 5 for permitting a user to sit over a toilet bowl (not shown) and a toilet lid 6 for selectively covering the toilet seat 5 are pivotally connected to the casing 3. In the casing 3, there is provided an open/close mechanism 14 which moves automatically the toilet seat 5, the toilet lid 6, or the toilet seat 5 and the toilet lid 6 as a unit to rotate relative to the toilet bowl between a vertical-upright position (which will be sometimes referred as fully opened position or opened state) and a horizontal-down position (which will be sometimes referred as fully closed position or closed state). In the casing 3, there is also provided a position detection device 13 which detects a current condition, of the respective toilet seat 5 and the toilet lid 6 i.e. which detects whether the toilet seat 5 (the toilet lid 6) is currently at its fully opened position, fully closed position, or in-transit position.

In addition, a human detection device 7 is also provided in the casing 3. The casing 3 has a front wall. The human detection device 7 is centered at the upper portion of the front wall of the casing 3 so that the human detection device 7 is not hidden or concealed by the toilet lid 6 even when the toilet lid is positioned at its fully closed or lowered position.

Figure 3:
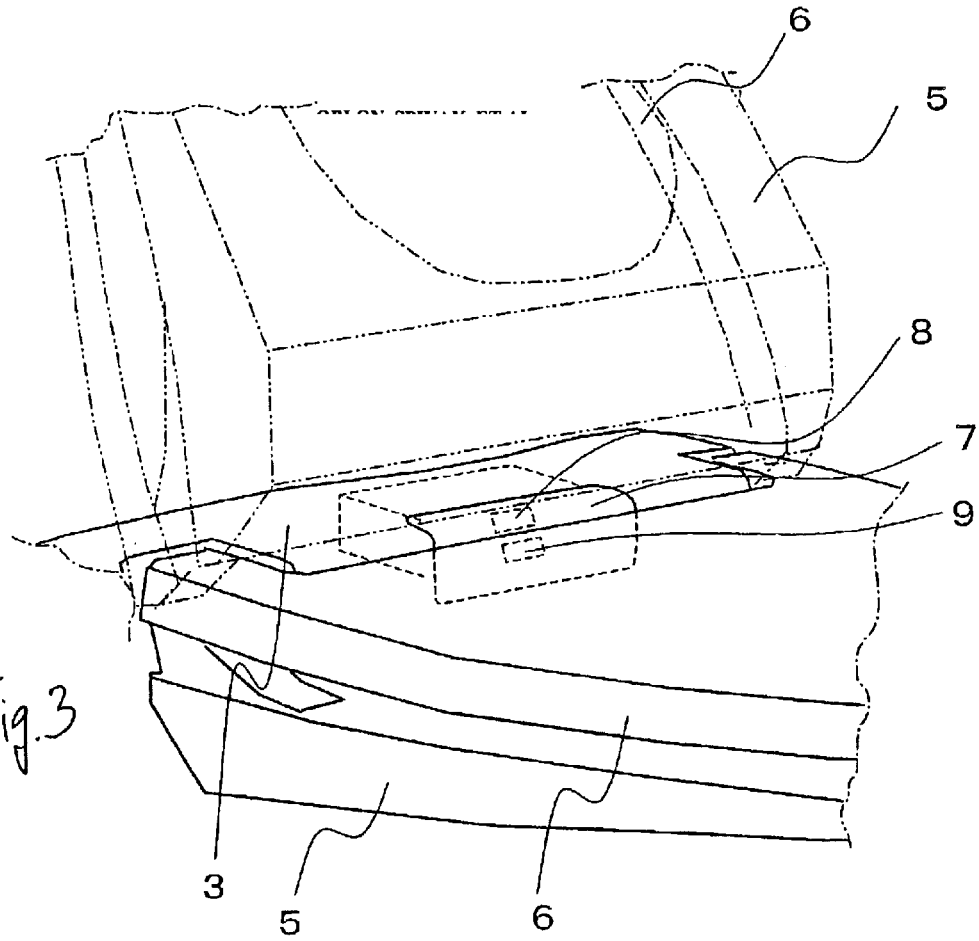
FIG. 3 shows a partial perspective view of the sanitary cleansing device shown in FIG. 1.

As best shown in FIG. 3, the human detection device 7 has a first human detection sensor 8 and a second human detection sensor 9. The first human detection sensor 8 is positioned or placed slightly above the second human detection sensor 9 in order not to detect or sense the toilet lid 6 which is being in the fully closed position. Placing or positioning the second human detection sensor 9 slightly below the first human detection sensor 8 is not to detect or sense the toilet seat 5 when both the toilet seat 5 and the toilet lid 6 are in the respective fully opened or raised positions, as indicated by phantom lines.

A microcomputer-based controller 90 is connected to the first human detection sensor 8 and the second human detection sensor 9. When the controller 90 receives a signal which represents that an individual moves to or approaches the toilet bowl 2, the controller 90 issues an order to the open/close mechanism 14 in order that only the toilet lid 6 is raised to its fully opened position or both the toilet lid 6 and the toilet seat 5 are raised to their respective fully opened positions. Manipulating an operation portion 4 enables the user to make a choice between the raising/lowering of only the toilet lid 6 and the raising/lowering of the toilet lid 6 and the toilet seat 5.

The second human detection sensor 9 is capable of sensing a moving-away of the individual from the toilet bowl 2 after his urine. When the controller 90 receives a signal which represents that the, individual's after-urine behavior, the controller 90 issues, an order to the open/close mechanism 14 so that only the toilet seat 5 is lowered to its fully closed position or both the toilet lid 6 and the toilet seat 5 are lowered to the respective fully closed positions. In addition, the controller 90 can flush a toilet to flush away an inside of the toilet bowl 2. It is to be noted that the operation portion 4 can be separated from the casing 3 as an independent or wireless handy operating apparatus.

Figure 4:
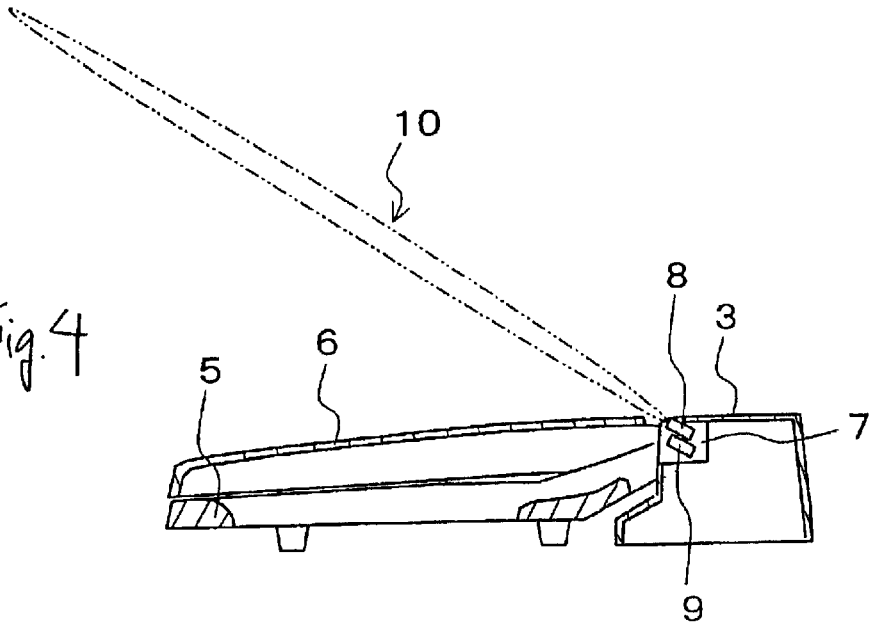
FIG. 4 shows how the sanitary cleansing device shown in FIG. 1 operates when a toilet lid and a toilet seat are in closed states, respectively.

FIG. 4 shows an emitted or illuminated light beam 10 from the human detection device 7 when both the toilet seat 5 and the toilet lid 6 are in the respective lowered or closed states. Under such circumstances, only the first detection sensor 8 is made valid for sensing whether or not the individual moves toward or approaches the toilet bowl 2, which ensures that the second human detection sensor 9 does not mistake the in-closed state toilet lid 6 for the individual approaching the toilet bowl 2. If a distance between the toilet bowl 2 and the individual moving thereto attains a predetermined value, upon receipt of a signal from the first detection sensor 8 the controller 99 causes the mechanism 14 to raise only the toilet seat 5 (alternately both the toilet seat 5 and the toilet lid 6) to open.

Figure 5:
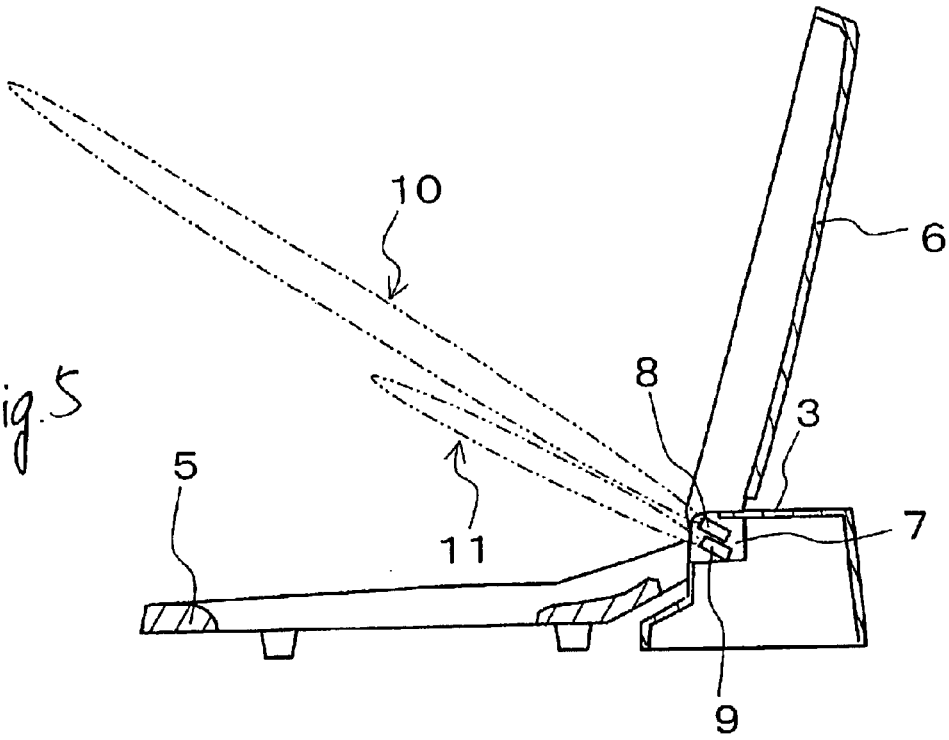
FIG. 5 shows how the sanitary cleansing device shown in FIG. 1 operates when the toilet lid is in its opened state and the toilet seat is in its closed state.

FIG. 5 shows, in addition to the illuminated light beam 10, another illuminated light beam 11 from the human detection device 7 when the toilet seats and the toilet lid 6 are in the lowered or closed state and the raised or opened state, respectively. Under such circumstances, only the first human detection sensor 8 is made valid for sensing whether or the individual moves toward or approaches the toilet bowl 2, while the second human detection sensor 9 checks whether or not the individual sits on the toilet seat 5 on the basis of a condition of the illuminated light beam 11.

Even though any person comes close to the toilet bowl 2 for the cleaning or maintenance thereof, so long as the condition of the illuminated light beam 11 from the second human detection sensor 9 fails to indicates that no individual sits on the toilet seat 5, no unexpected events can be prevented such as spouting of cleansing due to his/her by-mistake manipulation of the operation portion 4.

Figure 6:
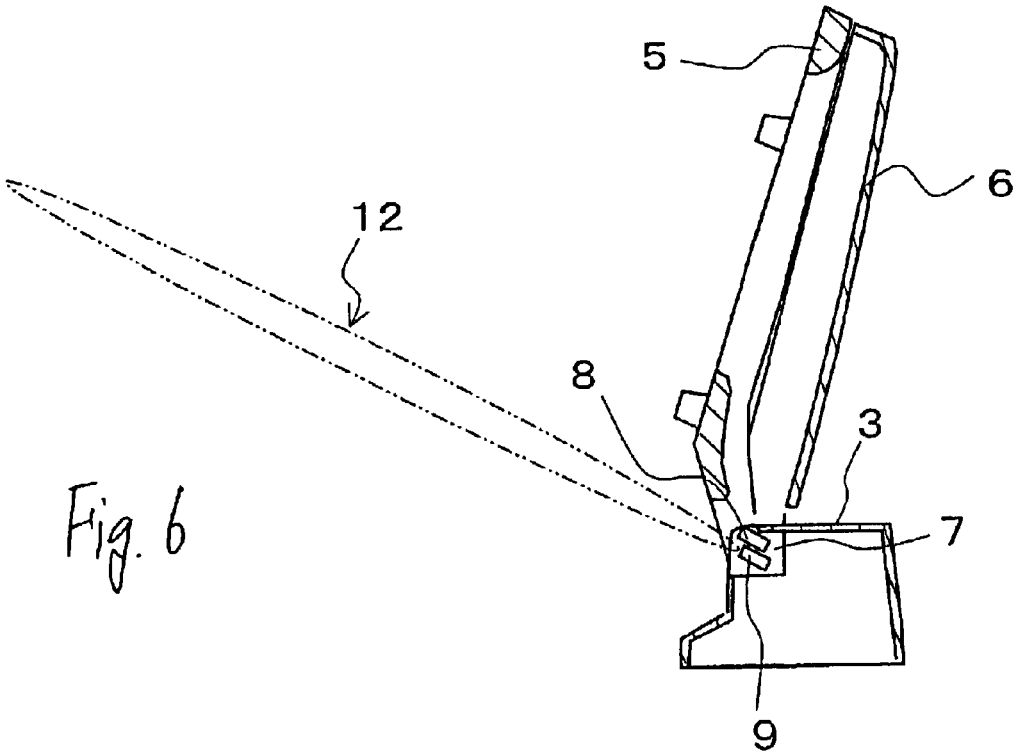
FIG. 6 shows how the sanitary cleansing device shown in FIG. 1 operates when the toilet lid and seat are in opened states, respectively.

FIG. 6 shows a further illuminated light beam 12 from the human detection device 7 when the toilet seat 5 and both the toilet lid 6 are in the raised or opened states, respectively. Under such circumstances, the illustrated illuminated light beam 12, only the second human detection sensor 9 serves for detecting whether or not an individual accesses to the toilet bowl 2, which prevents the first human detection sensor 8 to make a mistake the toilet seat 5 for the individual accessing to the toilet bowl 2.

In the present embodiment, the second human detection 9 is in the form of a ranging type photo detection sensor, which makes it possible to detect, by switching its detection range, both whether, or not an individual accesses to the toilet bowl 2 and whether or not such an individual sits on the toilet seat 5. Thus, not additional sensor is required which is capable of detecting his/her sitting state on the toilet seat 5, which reduces the production cost.

Alternately, the first human detection 8 may be in the form of a ranging type photo detection sensor. In such a structure, the first human detection sensor 8 and the second human detection sensor 9 detect individual's sitting on the toilet seat 5 and individual's access to the toilet bowl 2, respectively, when the toilet seat 5 is lowered to be in fully closed state and the toilet lid 6 is raised to fully open state.

Figure 7:
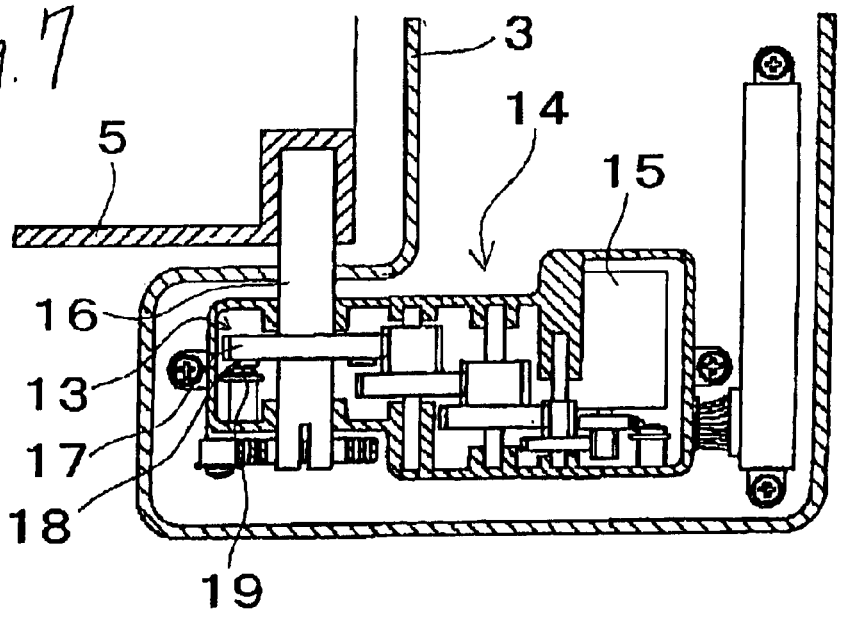
FIG. 7 shows a detailed structure of an automatic open/close mechanism.

The mechanism 14, as illustrated in FIG. 7, includes an electrically driven motor 15, a shaft 16 fixedly connected to the toilet seat 5, and a gear train interposed between the shaft 16 and the motor 15. The shaft 16 is in association of a position detection device 13 which detects current angular position of the toilet seat 5.

Upon receipt of signal from either of the first human detection sensor 8 and the second human detection sensor 9, the controller 90 begins to turn on the motor 15. The resulting rotation torque in positive/negative direction which is derived therefrom is transmitted, by way of the gear train, to the shaft 16 to open/close the toilet seat 5. Another mechanism (not shown) is provided which is similar to the mechanism 14 for an automatic opening/closing operation of the toilet lid 6.

Figure 8:
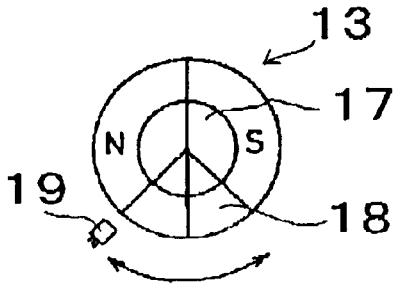
FIG. 8 shows a conceptual diagram of a position detection sensor.
Figure 9:
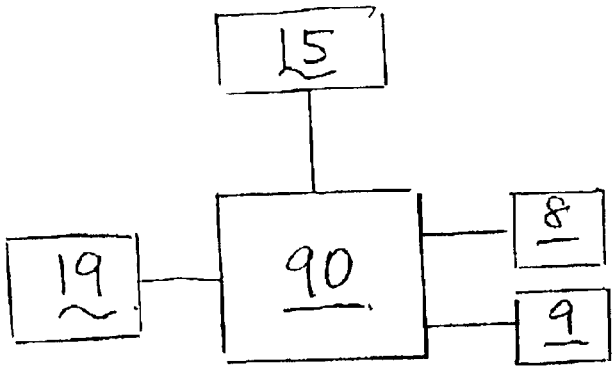
FIG. 9 shows a block diagram of an electronic controller of the sanitary cleansing device shown in FIG. 1.
Figure 10:
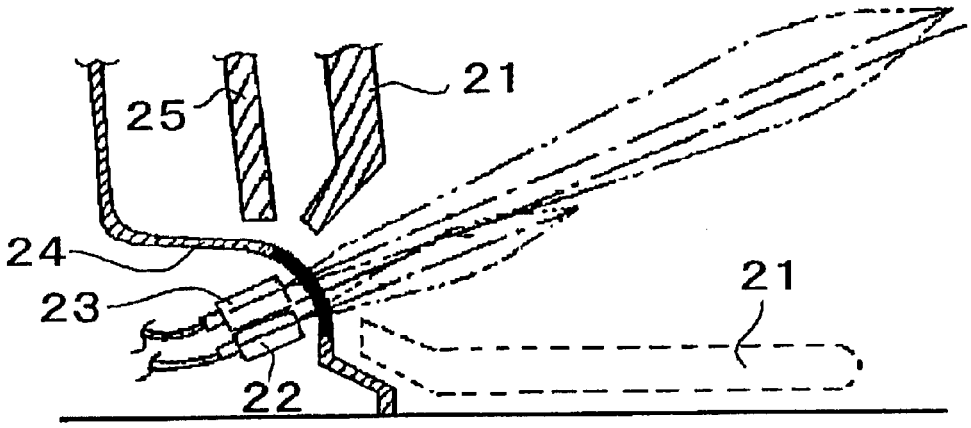
Fig. 10 (PRIOR ART)
FIG. 10 shows a conventional sanitary cleansing device.

As illustrated in FIG. 8, the position detection device 13 which detects the current angular position of the toilet seat 5 includes a disc 17 fixedly mounted on the shaft 16 for unitary rotation and a magnet 18 adhered to one of surfaces of the disc 17 to rotate together with the disc 17, and a magnet sensor 19 which detects N-pole/S-pole of the magnet 18. When the toilet seat 5 is brought into rotation from its closed state to open state, the pole of the magnet 18 to be sensed or detected by the magnet sensor 19 changes from N-pole to S-pole, which makes it possible to recognize whether the toilet seat 5 is in its closed state or open state.

Another position detection device (not shown), which is similar to the position detection 13, is provided for detecting a current angular position of the toilet lid 6. Combining this current detection sensor and that current detection sensor 13 makes it possible to recognize three states: (1) the toilet seat 5 and the toilet lid 6 are in the respective closed positions, (2) the toilet seat 5 is in its open position, while the toilet lid 6 is in its closed position, and (3) the toilet seat 5 and the toilet lid 6 are in the respective opened positions.

It is possible to make the controller 90 to operate only the first human detection sensor 8, to operate the first human detection sensor 8 and the second human detection sensor 9 such that one is used for detecting whether or not an individual accessing to the toilet bowl 2 and the other is used for detecting whether or not the individual sits on the toilet seat 5, and to operate only the second human detection sensor 9 when the toilet seat 5 and the toilet lid 6 are in the respective closed positions, (2) the toilet seat 5 is in its open position, while the toilet lid 6 is in its closed position, and (3) the toilet seat 5 and the toilet lid 6 are in the respective opened positions, respectively.

As apparent from the above-disclosure as described in great detail, the present invention is capable of providing the following advantages.

When the toilet lid is in its closed state, the first human detection sensor can detect an individual who is accessing the toilet bowl, which makes it possible to establish the automatic opening operation of the toilet lid.

Either of the first human detection sensor and the second detection sensor can be used, by switching its detection range, for detecting both of individual's accession to the toilet bowl and his/her sitting on the toilet seat, which can omit to preparing an additional sitting-on sensor, resulting in production cost reduction.

Preparing two or more sensors for detecting an individual who is accessing the toilet bowl makes it possible to ease restriction on arrangement of toilet seat and lid combination and appearance design therearound.

The invention has thus been shown and described with reference to specific embodiments, however, it should be understood that the invention is in no way limited to the details of the illustrated structures but changes and modifications may be made without departing from the scope of the appended claims.

What is claimed is:

1. A sanitary cleansing device comprising:

a toilet seat for permitting an individual to sit over a toilet bowl;

a toilet lid for selectively covering the toilet seat;

a first human detection sensor placed at a front portion of a casing such that the first human detection is made free from recognizing the toilet lid which is in its closed state; the first human detection sensor being capable of detecting an individual's approach to the toilet bowl when the toilet lid is closed;

a second human detection sensor placed at the front portion of the casing such that the second human detection is made free from recognizing the toilet seat when the toilet seat is in its opened state and the toilet lid is in its opened state; and an automatic open/close mechanism pivoting the toilet lid and/or the toilet seat upon receipt of a signal from either of the first human detection sensor and the second human detection sensor.

2. A sanitary cleansing device as set forth in claim 1, wherein (1) when the toilet seat and the toilet lid are in the respective closed states, only the first human detection sensor is made to detect whether or not an individual accesses to the toilet bowl, (2) when the toilet seat is in its closed state and the toilet lid is in its opened state, one of the first human detection sensor and the second human detection sensor is made to detect whether or not an individual accesses to the toilet bowl, the other is being made to detect whether or not the individual sits on the toilet seat, and (3) when the toilet seat and the toilet lid are in the respective opened states, only the second human detection sensor is made to detect whether or not an individual accesses to the toilet bowl.

3. A sanitary cleansing device as set forth in claim 1, wherein the first human detection sensor is capable of being switched to detect whether or not an individual accesses the toilet bowl, while the second human detection sensor is capable of being switched to detect whether or not the individual sits on the toilet seat.

4. A sanitary cleansing device as set forth in claim 1 further comprising a position detection device which is capable of detecting three conditions (1) the toilet seat and toilet lid are in the respective closed states, (2) the toilet seat and toilet lid are in the closed and opened states, respectively, and (3) the toilet seat and toilet lid are in the respective opened states.

5. A sanitary cleansing device as set forth in claim 4, wherein the position detection device is in the form of a pair of magnet sensors which are in association with the toilet seat and the toilet lid, respectively.

6. A sanitary cleansing device as set forth in claim 1, wherein at least one of the first human detection sensor and the second human detection sensor is in the form of a ranging type photoelectric sensor.

7. A sanitary cleansing device as set forth in claim 1, wherein the automatic open/close mechanism is configured to open at least one of the toilet lid and the toilet seat when the first human detection sensor detects an individual's approach to the toilet bowl when the toilet lid is closed.

8. A sanitary cleansing device as set forth in claim 1, further comprising a controller configured to be connected to at least one of the first human detection sensor and the second human detection sensor, wherein the controller is configured to send a signal to the automatic open/close mechanism to open or close at least one of the toilet lid and the toilet seat based on an output from the at least one of the first human detection sensor and the second human detection sensor.

9. A sanitary cleansing device comprising:

a toilet seat for permitting a user to sit over a toilet bowl;

a toilet lid for selectively covering the toilet seat;

a first human detection sensor placed at a position such that the first human detection sensor is made free from recognizing the toilet lid which is in its vertical-upright position a second human detection sensor placed at a position such that the second human detection sensor is made free from recognizing the toilet seat when the toilet seat is in its vertical-upright position and the toilet lid is in its horizontal-down position; and an automatic open/close mechanism causing the toilet lid, the toilet seat, or the toilet lid and the toilet seat as a unit to rotate relative to the toilet bowl between a vertical-upright position and a horizontal-down position upon receipt of a signal from either of the first human detection sensor and the second human detection sensor wherein the first human detection sensor is capable of detecting an individual's approach to the toilet bowl when the toilet lid is closed.

10. A sanitary cleansing device as set forth in claim 9 further comprising a position detection device which is capable of detecting three conditions (1) the toilet seat and toilet lid are in the respective horizontal-down positions, (2) toilet seat and toilet lid are in the horizontal-down and vertical-upright positions, respectively, and (3) the toilet seat and toilet lid are in the respective vertical-upright positions.

11. A sanitary cleansing device as set forth in claim 10, wherein the position detection device is in the form of a pair of magnet sensors which are in association with the toilet seat and the toilet lid, respectively.

12. A sanitary cleansing device as set forth in claim 9, wherein at least one of the first human detection sensor and the second human detection sensor is in the form of a ranging type photoelectric sensor.

13. A sanitary cleansing device as set forth in claim 9, wherein each of the toilet seat and the toilet lid has a rotation axis at its rear end portion, the rotation axis being placed in front of each of the first human detection sensor and the second human detection sensor.

14. A sanitary cleansing device as set forth in claim 9, wherein the first human detection sensor and the second human detection sensor are arranged vertically.

15. A sanitary cleansing device as set forth in claim 9, wherein (1) when the toilet seat and the toilet lid are in the respective horizontal-down position, only the first human detection sensor is made to detect whether or not the user accesses to the toilet bowl, (2) when the toilet seat is in the horizontal-down position and the toilet lid is in the vertical-upright position, one of the first human detection sensor and the second human detection sensor is made to detect whether or not the user accesses to the toilet bowl, the other is being made to detect whether or not the user sits on the toilet seat, and (3) when the toilet seat and the toilet lid are in the respective vertical-upright positions, only the second human detection sensor is made to detect whether or not the user accesses to the toilet bowl.

16. A sanitary cleansing device as set forth in claim 9, wherein the first human detection is capable of being switched to detect whether or not the user accesses to the toilet bowl, while the second human detection sensor is capable of being switched to detect whether or not the user sits on the toilet seat.

17. A sanitary cleansing device as set forth in claim 9, wherein the automatic open/close mechanism is configured to rotate at least one of the toilet lid and the toilet seat to the vertical-upright position when the first human detection sensor detects an individual's approach to the toilet bowl when the toilet lid is closed.

18. A sanitary cleansing device as set forth in claim 9, further comprising a controller configured to be connected to at least one of the first human detection sensor and the second human detection sensor, wherein the controller is configured to send a signal to the automatic open/close mechanism to rotate at least one of the toilet lid and the toilet seat between the vertical-upright and horizontal-down positions based on an output from the at least one of the first human detection sensor and the second human detection sensor.

* * * * *